US007057448B2

(12) United States Patent
Tanigawa et al.

(10) Patent No.: US 7,057,448 B2
(45) Date of Patent: Jun. 6, 2006

(54) VARIABLE OUTPUT-TYPE CONSTANT CURRENT SOURCE CIRCUIT

(75) Inventors: Hiroshi Tanigawa, Tsurugashima (JP); Shuichi Nakamura, Tsurugashima (JP); Satoru Yamane, Tsurugashima (JP)

(73) Assignee: Toko, Inc., Tokyo (JP)

( * ) Notice: Subject to any disclaimer, the term of this patent is extended or adjusted under 35 U.S.C. 154(b) by 9 days.

(21) Appl. No.: 10/858,760

(22) Filed: Jun. 1, 2004

(65) Prior Publication Data

US 2004/0246046 A1 Dec. 9, 2004

(30) Foreign Application Priority Data

Jun. 6, 2003 (JP) ..... 2003-162262

(51) Int. Cl.
*G05F 1/10* (2006.01)

(52) U.S. Cl. ..... 327/543

(58) Field of Classification Search ..... 323/312, 323/313, 314, 315, 316; 327/143, 535, 537, 327/538, 539, 540, 541, 543; 363/49
See application file for complete search history.

(56) References Cited

U.S. PATENT DOCUMENTS 4,769,589 A * 9/1988 Rosenthal ..... 323/313
5,083,079 A * 1/1992 Plants ..... 323/313
5,180,967 A * 1/1993 Yamazaki ..... 323/315
5,243,231 A * 9/1993 Baik ..... 327/544
5,404,096 A 4/1995 Thiel
5,565,811 A * 10/1996 Park et al. ..... 327/546
5,949,227 A 9/1999 Bujanos
5,969,549 A * 10/1999 Kim et al. ..... 327/143
6,060,918 A * 5/2000 Tsuchida et al. ..... 327/143
6,163,468 A 12/2000 Barnes
6,441,680 B1 * 8/2002 Leung et al. ..... 327/541
6,448,844 B1 * 9/2002 Cho ..... 327/538
6,496,057 B1 * 12/2002 Wada et al. ..... 327/543

(Continued)

FOREIGN PATENT DOCUMENTS

JP 5-282058 10/1993

(Continued)

OTHER PUBLICATIONS

Rincon-Mora G A, "Voltage References: From Diodes to Precision High-Order Bandgap Circuits", 2002, IEEE Press, Wiley, USA, pp. 29-35, 43.

(Continued)

*Primary Examiner*—Jeffrey Zweizig
(74) *Attorney, Agent, or Firm*—Cohen, Pontani, Lieberman & Pavane

(57) ABSTRACT

Disclosed is a variable output-type constant current source circuit capable of varying its output current in a stepwise manner without the complication in circuit configuration and the increase in size of a semiconductor circuit board for incorporating the circuit therein. The constant current source circuit comprises a first self-biasing type constant current circuit 3*a* configured such that transistors M1, M2 are operable to cooperatively supply a given voltage across a resistor RS to generate a stabilized current $I_{R1}$. In order to vary the output current, the constant current source circuit includes a switching circuit 5 (transistor M5) connected in series to a series circuit connecting in series the transistor M1 and the resistor RS, and a second constant current circuit 4 connected in parallel to a series circuit connecting in series the transistor M1, the resistor RS and the transistor M5. The second constant current circuit 4 is also configured to serve as an activation circuit for the first constant current circuit 3*a*.

4 Claims, 2 Drawing Sheets

U.S. PATENT DOCUMENTS

| | | | | |
|---|---|---|---|---|
| 6,586,975 | B1 | 7/2003 | Nagaya et al. | |
| 6,600,361 | B1 * | 7/2003 | Nagaya et al. | 327/538 |
| 6,734,719 | B1 * | 5/2004 | Tanzawa et al. | 327/541 |
| 6,831,505 | B1 * | 12/2004 | Ozoe | 327/541 |

FOREIGN PATENT DOCUMENTS

| | | |
|---|---|---|
| JP | 8-228114 | 9/1996 |
| JP | 8-241140 | 9/1996 |
| JP | 2002-116831 | 4/2002 |

OTHER PUBLICATIONS

Paul R. Gray et al., "Analysis and Design of Analog Integrated Circuits", Second Edition, (English version pp.: 277-285, 730-735; Japanese version: pp. 258-263 and 304-307).

* cited by examiner

VARIABLE OUTPUT-TYPE CONSTANT CURRENT SOURCE CIRCUIT

BACKGROUND OF THE INVENTION

1. Field of the Invention

The present invention relates to a variable output-type constant current source circuit capable of varying its output current in a stepwise manner, and more particularly to a technology for allowing an output current value of a variable output-type constant current source circuit to be sufficiently varied.

2. Description of the Prior Art

An integrated circuit incorporating various electronic circuits in high-density packaging often has the need for supplying a stable current to each of the electronic circuits to prevent a supply voltage and other disturbances from adversely affecting on the operation thereof.

There have been known some constant current source circuits for providing a stable current to an electronic circuit, for example, as shown in FIGS. 1 and 2.

The constant current source circuit illustrated in FIG. 1 as a first conventional example is configured as follows.

The respective gates of transistors M1 and M2 each composed of an N-channel type MOSFET are connected to one another through a common connection, and the transistor M2 is short-circuited between the drain and gate thereof. The source of the transistor M1 is connected to GND via a resistor RS, and the source of the transistor M2 is connected directly to GND. The respective gates of transistors M3 and M4 each composed of a P-channel type MOSFET are connected to one another through a common connection, and the transistor M3 is short-circuited between the drain and gate thereof. Each of the sources of the transistors M3 and M4 is connected directly to a power supply point VCC.

The respective drains of the transistors M3 and M1 are connected to one another through a common connection, and the respective drains of the transistors M4 and M2 are connected to one another through a common connection. The transistors M1, M2, M3 and M4 and the resistor RS make up a self-biasing type constant current circuit 3*b*.

The transistor M1 is designed to have a channel size (the ratio of channel width W/channel length L) N times greater than that of the transistor M2. While each of the channel sizes of the transistors M3 and M4 may be selectively set at an appropriate value in practice, given that the transistors M3 and M4 have the same channel size only for the sake of simplicity (given that transistors M3 and M4 illustrated in another circuit diagram also have the same channel size).

The constant current source circuit also includes an output transistor M6 composed of an N-channel type MOSFET, and the gate of the output transistor M6 is connected to the gate of the transistor M2 through a common connection. The source of the output transistor M6 is connected to GND, and the drain of the output transistor M6 is connected to a first output terminal 1. The constant current source circuit further includes an output transistor M7 composed of a P-channel type MOSFET, and the gate of the output transistor M7 is connected to the gate of the transistor M4 through a common connection. The source of the output transistor M7 is connected to the power supply point VCC, and the drain of the output transistor M7 is connected to a second output terminal 2.

The constant current source circuit in FIG. 1 operates as follows.

The transistors M3 and M4 are operable to allow a current to flow through the transistors M1 and M2 different in channel size, at the same value. Then, the transistors M1 and M2 operating in a cooperative manner under different current densities create a given voltage across the resistor RS. This voltage allow a highly stable current $I_R$ (hereinafter referred to as "stabilized current") to flow through a line of the resistor RS and the transistors M1 and M3. Further, a reference current $I_{ref}$ equal to the stabilized current $I_R$ flows through a line of the transistors M2 and M4, and then an output current proportional to the reference current $I_{ref}$ (=stabilized current $I_R$) is picked up from the output transistors M6 and M7.

The configuration and the operation of the circuit in FIG. 1 are disclosed, for example, in "Design Techniques of Analog Integrated Circuits (Vol. 1)" co-authored by P. R. Grey and P. G Meyer (pp 263–265, BAIFUKAN Co., Ltd., Dec. 15, 1990), "Design Techniques of Analog Integrated Circuits (Vol. 2)" co-authored by P. R. Grey and P. G. Meyer (pp 308–309, BAIFUKAN Co., Ltd., Dec. 15, 1990), and Japanese Patent Laid-Open Publication No. 08-228114 or 2002-116831.

The constant current source circuit illustrated in FIG. 2 as a second conventional example is configured as follows.

The gate of a transistor M8 composed of an N-channel type MOSFET is connected to the drain of a transistor M9 composed of an N-channel type MOSFET, and the source of the transistor M8 is connected to the gate of the transistor M9. The source of the transistor M9 is connected directly to GND, and the source of the transistor M8 is connected to GND via a resistor RS. The respective gates of transistors M3 and M4 each composed of a P-channel type MOSFET are connected to one another through a common connection, and the transistor M3 is short-circuited between the drain and gate thereof. Each of the sources of the transistors M3 and M4 is connected directly to a power supply point VCC.

The respective drains of the transistors M3 and M8 are connected to one another through a common connection, and the respective drains of the transistors M4 and M9 are connected to one another through a common connection. The transistors M3, M4, M8 and M9 and the resistor RS make up a self-biasing type constant current circuit 3*c*.

The constant current source circuit in FIG. 2 operates as follows.

Based on the transistors M8 and M9 operating in a cooperative manner, a given voltage approximately equal to a threshold voltage $V_{th}$ of the transistor M9 is created across the resistor RS. This voltage allows a stabilized current $I_R$ to flow through a line of the resistor RS and the transistors M8 and M3. Further, a reference current $I_{ref}$ equal to the stabilized current $I_R$ flows through a line of the transistors M9 and M4, and then an output current proportional to the reference current $I_{ref}$(=stabilized current $I_R$) is picked up from output transistors M6 and M7.

The configuration and the operation of the circuit in FIG. 2 are disclosed, for example, in "Design Techniques of Analog Integrated Circuits (Vol. 1)" co-authored by P. R. Grey and P. G. Meyer (pp 259–263, BAIFUKAN Co., Ltd., Dec. 15, 1990), "Design Techniques of Analog Integrated Circuits (Vol. 2)" co-authored by P. R. Grey and P. G. Meyer (pp 305–307, BAIFUKAN Co., Ltd., Dec. 15, 1990), and Japanese Patent Laid-Open Publication No. 2002-116831.

The constant current circuit having the configuration as shown in FIG. 1 or 2 is operable to stabilize the circuit operation on a self-biasing basis. As used in the specification, the term "self-biasing" means a feedback control characterized in that, based on a current mirror operation between the transistors M3 and M4, the reference current $I_{ref}$ flowing through the transistor M2 (or M9) is determined by the stabilized current $I_R$ flowing through the transistor M1 (or M8). Such a self-biasing type constant current source circuit has two operation points allowing the circuit to be stably operated thereat (hereinafter referred to as "stable operation points"). Specifically, the stable operation points consist of one point where "the stabilized current=zero" and the other point where "the stabilized current=a given current value". In use of the circuit in FIG. 1 or 2, one of the stable operation points where the stabilized current=zero involves the following problem.

Firstly, even if a power is simply supplied from the current supply point VCC to activate the circuit, no current will flow through the transistors M1, M2, M3 and M4 (or M8, M9, M3 and M4). If nothing is done, the circuit in FIG. 1 (or FIG. 2) will never be activated.

Thus, it is typically required to additionally provide an activation circuit for injecting a current into a connection node P1 (FIG. 1) or P2 (FIG. 2) in the circuit. The activation circuit is essentially configured such that the current injection into the connection node P1 or P2 is discontinued just after activation of the constant current source circuit so as not to interfere with the normal operation of the constant current circuit 3*b* or 3*c*.

Secondly, most of current electronic devices have a function of shifting a regular operation mode to another operation mode having a power consumption less than that in the regular operation mode (hereinafter referred to as "power saving operation mode") if the device is not operated for a predetermined period of time. A constant current source circuit for use in such electronic devices is desirably designed to switchably control an output current in such a manner that it is increased in the regular operation mode, and reduced in the power saving operation mode. However, the circuit in FIG. 1 or 2 having only one stable operation point other than the point where the stabilized current=zero cannot vary the value of the output current if nothing is done. Thus, in order to vary the value of the output current, an additional control circuit for switching the output current is essentially provided between the output transistors M6, M7 and the constant current circuit 3*b* (or 3*c*) while bearing the disadvantage of complication in circuit configuration. One example of such a control circuit is disclosed, for example, in Japanese Patent Laid-Open Publication No. 08-241140.

The activation circuit or the control circuit additionally incorporated in the constant current circuit causes problems of the complication in circuit configuration and the increase in size of a semiconductor circuit board.

Further, while the resistor RS provided in the circuit in FIG. 1 or 2 may be set at a larger resistance value to reduce the output current of the circuit, the output current can be actually reduced to about several hundred nA only after the resistance value of the resistor RS is set at several MΩ. If a high resistance element of several MΩ is formed on a semiconductor circuit board, it will undesirably occupy a fairly large area on the board.

SUMMARY OF THE INVENTION

In view of the above problems, it is therefore an object of the present invention to provide a variable output-type constant current source circuit capable of varying its output current in a stepwise manner.

It is another object of the present invention to provide a variable output-type constant current source circuit which is free of the complication in circuit configuration and the increase in size of a semiconductor circuit board for incorporating the circuit therein.

In order to achieve the above objects, the present invention provides a variable output-type constant current source circuit comprising: a first self-biasing type constant current circuit including a resistor, a first transistor connected in series to the resistor, a second transistor for supplying a given voltage across the resistor in cooperation with the first transistor to generate a reference current, a third transistor connected in series to the first transistor, and a fourth transistor connected in series to the second transistor and associated with the third transistor to form a current mirror circuit; a switching circuit including a fifth transistor connected in series to the resistor; and a second constant current circuit connected in parallel to a series circuit connecting in series the first transistor, the resistor and the fifth transistor, wherein the fifth transistor is adapted to vary a current passing through the second and fourth transistors, according to the state thereof, so as to vary an output current from the constant current source circuit.

Specifically, the first and second transistors are operable to cooperatively supply a given voltage across the resistor connected in series to the first transistor, to generate a stabilized current. The third and fourth transistors connected in series, respectively, to the first and second transistors are operable to allow the stabilized current to be correlated with a reference current. The first to fourth transistors and the resistor make up the first self-biasing type constant current circuit. In a preferred embodiment of the present invention, the constant current source circuit may include a first output transistor arranged to form a current mirror circuit in association with the second transistor, and a second output transistor arranged to form a current mirror circuit in association with the fourth transistor.

The constant current source circuit of the present invention further includes the switching circuit having the fifth transistor, and the second constant current circuit. The switching circuit is connected in series to a series circuit connecting in series the first transistor and the resistor, and the second constant current circuit is connected in parallel to a series circuit connecting in series the first transistor, the resistor and the fifth transistor.

In a preferred embodiment of the present invention, the fifth transistor constituting the switching circuit may be turned on/off in response to a control signal which is externally supplied to a control terminal. Further, the second constant current circuit may be composed of a depression-type MOSFET which is short-circuited between the gate and source thereof.

In the above constant current source circuit, when the fifth transistor is turned on in response to the external control signal, the first constant current circuit performs a regular operation. During this regular operation, an output current obtained from the first and second output transistors has a value proportional to the sum of the respective stabilized currents of the first and second constant current circuits.

When the fifth transistor is turned off in response to the external control signal, the first constant current circuit loses the function of generating the stabilized current. During this operation, an output current obtained from the first and second output transistors has a value substantially proportional to the stabilized current of the second constant current circuit.

In an operation for activating the constant current source circuit, the second constant current circuit may also serve as an activation circuit for the first constant current circuit.

According to the above specific embodiment of the present invention, the value of the output current can be varied two-stepwise in response to the state of the switching circuit. The second constant current circuit may be compose of a depression-type transistor configured to allow a current flowing therethrough to be limited to a minute value, so as to prevent the complication in circuit configuration and the increase in size of a semiconductor circuit board. Furthermore, the second constant current circuit may be configured to serve as an activation circuit for the first constant current circuit, so as to provide an enhanced advantage of preventing the complication in circuit configuration and the increase in size of a semiconductor circuit board.

DESCRIPTION OF THE PREFERRED EMBODIMENTS

Figure 3:
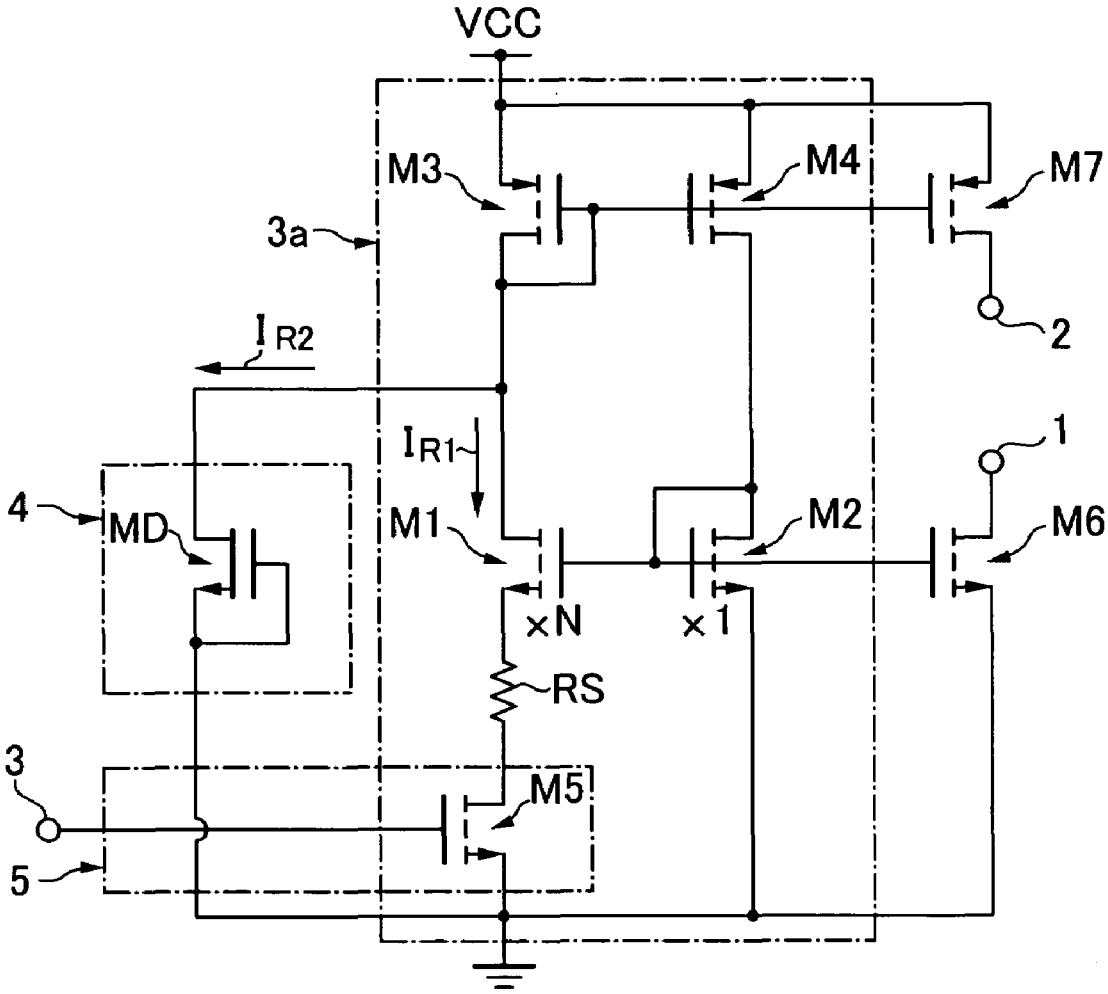
FIG. 3 is a circuit diagram showing a variable output-type constant current source circuit according to one embodiment of the present invention.

FIG. 3 is a circuit diagram showing a variable output-type constant current source circuit capable of varying its output current in a stepwise manner, according to one embodiment of the present invention. The constant current source circuit in the FIG. 3 is configured as follows.

The respective gates of transistors M1 and M2 each composed of an N-channel type MOSFET are connected to one another through a common connection, and the transistor M2 is short-circuited between the drain and gate thereof. The source of the transistor M1 is connected to GND via a resistor RS connected in series thereto and the main current path of a transistor M5, and the source of the transistor M2 is connected directly to GND. The gate of the transistor M5 is connected to a signal input terminal 3. The respective gates of transistors M3 and M4 each composed of a P-channel type MOSFET are connected to one another through a common connection, and the transistor M3 is short-circuited between the drain and gate thereof. Each of the sources of the transistors M3 and M4 is connected directly to a power supply point VCC.

The respective drains of the transistors M3 and M1 are connected to one another through a common connection, and the respective drains of the transistors M4 and M2 are connected to one another through a common connection. The gate of an output transistor M6 composed of an N-channel type MOSFET is connected to the gate of the transistor M2 through a common connection. The output transistor M6 has a source connected to GND, and a drain connected to a first output terminal 1. The gate of an output transistor M7 composed of a P-channel type MOSFET is connected to the gate of the transistor M4 through a common connection. The output transistor M7 has a source connected to the power supply point VCC, and a drain connected to a second output terminal 2. The drain of a transistor MD composed of a depression/N-channel type MOSFET short-circuited between the gate and source thereof is connected to the drain of the transistor M1, and the source of the transistor MD is connected to GND.

The transistor M5 makes up a switching circuit 5. The transistors M1, M2, M3, M4 and M5 and the resistor RS make up a first constant current circuit 3*a*, and the transistor MD makes up a second constant current circuit 4.

Figure 1:
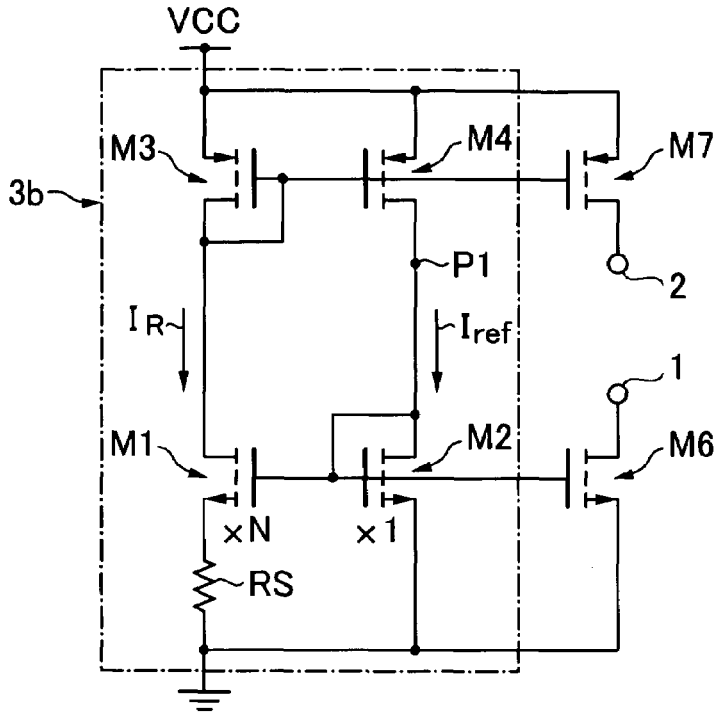
FIG.1 (PRIOR ART)
FIG. 1 is a circuit diagram showing a first conventional example of a fundamental constant current source circuit.

Given that the relationship between the respective channel sizes of the transistors M1, M2, M3, M6 and M7 in FIG. 3 is the same as that of the conventional circuit in FIG. 1.

Except that the transistor M5 is commented in series between the resistor RS and GND, and the main current path of the transistor MD is connected in parallel to the series circuit connecting in series the transistor M1, the resistor RS and the transistor M5, the configuration of the circuit in FIG. 3 is substantially the same as that of the circuit in FIG. 1. However, differently from the circuit in FIG. 1, the circuit in FIG. 3 configured as above is operable to vary its output current as follows.

When a control signal supplied through the signal input terminal 3 is in a High level, the transistor M5 of the switching circuit 5 goes into its ON state. In this mode, the constant current circuit 3*a* has substantially the same configuration as that of the constant current circuit 3*b* in FIG. 1. That is, the transistors M1 and M2 operate in a cooperative manner under different current densities to generate a given voltage across the resistor RS. Thus, a first stabilized current $I_{R1}$ having a value determined by the resistance value of the resistor RS and the value of the given voltage flows through a series circuit connecting in series the transistor M1, the resistor RS and the transistor M5.

During this mode, the transistor MD of the second constant current circuit 4 operates while maintaining the voltage $V_{GS}$ between the gate and source thereof at a value of zero, and thereby a second stabilized current $I_{R2}$ having a value determined by the characteristics of the depression-type transistor MD flows into the second constant current circuit 4. Thus, a combined current consisting of the sum of the first stabilized current $I_{R1}$ flowing into the transistor M1 and the second stabilized current $I_{R2}$ flowing into the transistor MD flows through the main current path of the transistor M3. A current flowing through the transistors M2, M4 has a value equal to that of the combined current, and thereby an output current picked up from the output transistors M6, M7 has a value proportional to the combined current ($=I_{R1}+I_{R2}$).

When the external control signal is in a Low level, the transistor M5 goes into its OFF state. In this mode, no current flows through the transistor M1 and the resistor RS. Thus, the first constant current circuit 3*a* loses the function of generating the first stabilized current $I_{R1}$. During this mode, only the second stabilized current $I_{R2}$ flowing into the transistor MD flows through the main current path of the transistor M3. A current flowing through the transistors M2, M4 has a value equal to that of the second stabilized current $I_{R2}$, and thereby an output current picked up from the output transistors M6, M7 has a value proportional to the second stabilized current $I_{R2}$.

As above, the circuit in FIG. 3 allows the value of the output current to be varied two-stepwise in response to the switching operation in the transistor M5 of the switching circuit 5.

In the above circuit, the value of the second stabilized current $I_{R2}$ is determined by the characteristics of the depression-type transistor MD. Thus, the transistor MD can be selectively configured to allow the second stabilized current $I_{R2}$ to have a minute value, for example, about several hundred nA, so as to eliminate the need for setting the resistor RS at a high resistance value. This allows a minute output current to be obtained without increasing the size of a semiconductor circuit board. In addition, the complication in circuit configuration can be certainly avoided.

The transistor MD constituting the second constant current circuit 4 is maintained in its operative state because it is composed of a depression-type MOSFET having a negative threshold, and short-circuited between the gate and source thereof. Thus, when a power is supplied from the power supply point VCC to the circuit in FIG. 3, the transistor MD draws a current through the transistor M3. In response to the current passing through the transistor M3, the first constant current circuit 3*a* in its deactivated state is activated. In this manner, the second constant current circuit 4 also serves as an activation circuit for the first constant current circuit 3*a*. Thus, the circuit in FIG. 3 has no need for providing an additional activation circuit. In addition, as a mechanism for varying the output current, the circuit in FIG. 3 is additionally provided with only the second constant current circuit 4 (transistor MD) and the switching circuit 5 (transistor M5). Thus, the constant current source circuit is free of the disadvantage of complication in circuit configuration.

Figure 2:
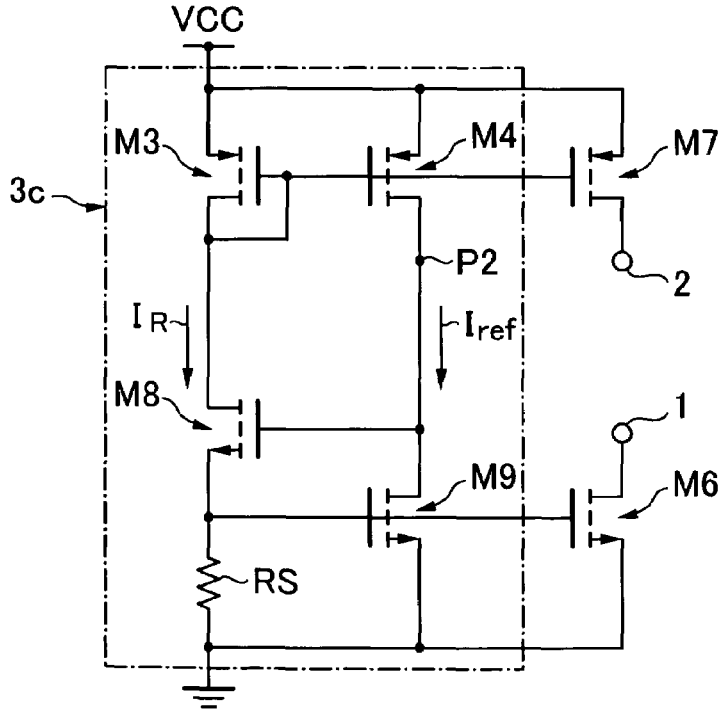
FIG.2 (PRIOR ART)
FIG. 2 is a circuit diagram showing a second conventional example of a fundamental constant current source circuit.

While the constant current source circuit in FIG. 3 according to one embodiment of the present invention is configured by additionally incorporating the switching circuit 5 and the second constant current circuit into the constant current source circuit in FIG. 1, the present invention is not limited to such a configuration. For example, the constant current source circuit of the present invention may be configured by additionally incorporating the switching circuit and the second constant current circuit into the constant current source circuit in FIG. 2. In this case, a transistor constituting the switching circuit must be connected in series to a series circuit connecting in series the transistor M8 and the resistor RS, and the second constant current circuit 4 must be connected in parallel to a series circuit connecting in series the transistor M8, the resistor RS and the switching circuit.

Further, while the second constant current circuit 4 composed of the depression-type transistor MD in the constant current source circuit in FIG. 3 according to one embodiment of the present invention is advantageous to the simplification of circuit configuration and the downsizing of a semiconductor circuit board, the present invention is not limited to such a configuration, but the second constant current circuit may have any other suitable configuration. In this case, it is understood that the second constant current circuit is desirably configured to go into its operative state immediately after a power is supplied to the power source point VCC, so as to allow any activation circuit for the first constant current circuit to be omitted.

What is claimed is:

1. A variable output-type constant current source circuit comprising:

a first self-biasing type constant current circuit including a resistor, a first transistor connected in series to said resistor, a second transistor for supplying a given voltage across said resistor in cooperation with said first transistor to generate a reference current, a third transistor connected in series to said first transistor, and a fourth transistor connected in series to said second transistor and associated with said third transistor to form a current mirror circuit;

a switching circuit including a fifth transistor connected in series with said resistor, the switching circuit being arranged so as to cut off current flow through said first transistor without preventing current flow through said second transistor; and a second constant current circuit comprising a sixth transistor which is a depletion-type MOSFET, wherein a main current path of said sixth transistor is connected in parallel to a series circuit of said second transistor, said resistor and said fifth transistor, and wherein a gate and a source of said sixth transistor are shorted;

wherein when said fifth transistor is turned off, a current passing through said second and fourth transistors becomes a relatively small value corresponding to current flowing through said second constant current circuit, and when said fifth transistor is turned on, a current passing through said second and fourth transistors becomes a relatively large value corresponding to a combined current flowing through said first and second constant current circuits.

2. The variable output-type constant current source circuit as defined in claim 1, which further includes a first output transistor connected to said second transistor in such a manner that it performs a current mirror operation in association with said second transistor, and a second output transistor connected to said fourth transistor in such a manner that it performs a current mirror operation in association with said fourth transistor.

3. The variable output-type constant current source circuit as defined in claim 1, wherein the respective gates of said first and second transistors in said self-biasing type constant current circuit are different in a channel size, wherein said second transistor is short-circuited between the drain and gate thereof, the respective gates of said first and second transistors being connected to one another through a common connection, the source of said second transistor being connected to GND, and the source of said first transistor being connected to GND via said resistor and said fifth transistor.

4. The variable output-type constant current source circuit as defined in claim 2, wherein the respective gates of said first and second transistors in said self-biasing type constant current circuit are different in a channel size, wherein said second transistor is short-circuited between the drain and gate thereof, the respective gates of said first and second transistors being connected to one another through a common connection, the source of said second transistor being connected to GND, and the source of said first transistor being connected to GND via said resistor and said fifth transistor.

* * * * *